343-754 SR
5/11/76 OR 3,956,752

United States Patent [19]
Phelan et al.
[11] 3,956,752
[45] May 11, 1976

[54] POLARIZATION INSENSITIVE LENS FORMED OF SPIRAL RADIATORS

[75] Inventors: Harry Richard Phelan, Indialantic; Kenneth M. Jagdmann; Conrad Henry Ottenhoff, both of Melbourne, all of Fla.

[73] Assignee: Harris Corporation, Cleveland, Ohio

[22] Filed: Mar. 12, 1975

[21] Appl. No.: 557,585

[52] U.S. Cl. ..... 343/754; 343/895
[51] Int. Cl.[2] ..... H01Q 1/36
[58] Field of Search ..... 343/753, 854, 895

[56] References Cited
UNITED STATES PATENTS
3,906,514 9/1975 Phelan ..... 343/895

*Primary Examiner*—Eli Lieberman

[57] ABSTRACT

A polarization insensitive lens is disclosed for receiving and reradiating electromagnetic energy, which may be either left-hand circular polarized or right-hand circular polarized or of any linear polarization or, in fact, of any polarization state. Each lens is comprised of a pair of spaced apart multiarm/antenna elements of opposite geometric polarization. The elements are located on opposite sides of a ground plane and spaced therefrom by ¼ wave length. The arms of each antenna element are constructed such that both right-hand circular polarized and left circular polarized signals received by one element experience the same phase delay while being transmitted and then reradiated from the other antenna element.

12 Claims, 13 Drawing Figures

POLARIZATION INSENSITIVE LENS FORMED OF SPIRAL RADIATORS

This invention relates to the art of the antennas and, more particularly, to an improved antenna lens structure adapted for use in a lens array and which is particularly applicable for receiving electromagnetic energy of any polarization state and reradiating the energy wherein received energy of any polarization experiences the same phase delay to thereby minimize phase dispersion.

Whereas the invention will be described herein with respect to antenna elements, which each have a plurality of spiral shaped arms, the invention is not limited thereto so long as the arms exhibit a spatial configuration such that when they receive circular polarized energy, signals are developed along the arms which differ in phase from each other.

In many radar and communications applications, it is desirable to have polarization insensitive operation. Thus, for example, where a microwave lens is used as the collimator, the lens must provide the required phase distribution for any incident polarization. Consequently then, it is desirable in such an application that a polarization insensitive lens be provided.

A lens array employing spiral elements is described in the U.S. Pat. to A. E. Marston No. 3,045,237. Each lens is comprised of two spiral antenna elements with each antenna element being comprised of two arms of the same length. The two spiral elements are interconnected by a two-wire transmission line. For co-polarized incident energy currents induced by the first spiral in the two-wire line are out of phase. This is correct excitation for the two-wire line so that energy is propogated to the second spiral and efficiently re-radiated. When cross-polarized energy is incident, the first spiral induces currents in the two-wire line which are in phase. This is incorrect excitation of the line so that energy is not propogated to the second spiral. Thus, this lens type is polarization sensitive.

It is a specific object of the present invention to provide a lens construction employing two antenna elements each of which is comprised of four spiral arms having a phase progression of 0°, 90°, 180°, and 270° at the inner terminals so that electromagnetic energy received by one element, which is either copolarized or cross-polarized with respect to the geometric polarization of the element may be transmitted from one element to the other for subsequent reradiation.

It is a specific object of the present invention to provide a polarization insensitive lens adapted for use in an array of such lenses for receiving and efficiently reradiating circular polarized electromagnetic energy of either polarity as well as energy which is linearly polarized.

It is a still further object of the present invention to provide such a lens, which imparts a preselected phase distribution to energy of either sense of circular or linear polarization.

It is a still further object of the present invention to provide such a lens, which will provide the required phase distribution for any incident polarization.

It is a still further object of the present invention to provide such a lens having two spaced apart elements for respectively receiving and reradiating electromagnetic energy and wherein the path length for signals received in one element and transmitted to the other element for reradiation is the same for either right-hand or left-hand circular polarized signals.

It is a still further object of the present invention to provide such a lens which is constructed with light-weight components such as printed circuits, permitting low cost construction in large volume.

It is a still further object of the present invention to provide such a lens which is small in size and exhibits a low weight characteristic, which is obtained by integrating the phase shift function directly into the lens element.

It is a still further object of the present invention to provide such a lens which is constructed so as to exhibit low insertion loss, on the order of less than 0.5 db.

In accordance with one aspect of the present invention a polarization insensitive lens is provided which serves to receive and reradiate electromagnetic energy. This lens is comprised of first and second spaced apart antenna elements which serve to respectively receive and reradiate electromagnetic energy. Each antenna element is comprised of an even pair of electrically conductive spiral arms which are spaced from each other. The arms have a common axis of rotation and each arm has an inner and outer arm end. The inner arm ends are rotationally displaced about the axis relative to each other by a given angle so as to achieve a given rotational phase progression about the common axis. These two antenna elements are of opposite geometric winding sense. Transmission means, including four conductors, serve to connect a respective arm of the first element with an associated arm of the second element. Thus the path length of current flow from the receiving element to the radiating element is the same, regardless of whether the received energy is co-polarized or cross-polarized.

In accordance with a more limited aspect of the present invention the transmission means is on the order of one half wave length.

In accordance with a still further aspect of the present invention each conductor serves to interconnect an inner arm end of the first element with an inner arm end of an associated arm of the second element.

In accordance with a still further aspect of the present invention, the antenna elements respectively lie in parallel planes and are located on opposite sides of a ground plane which is located one-fourth of a wave length from each of the antenna elements.

DESCRIPTION OF PREFERRED EMBODIMENT

The foregoing and other objects and advantages of the invention will become more readily apparent from the following description of the preferred embodiment of the invention as taken in conjunction with the accompanying drawings, which are a part hereof and wherein.

Figure 1:
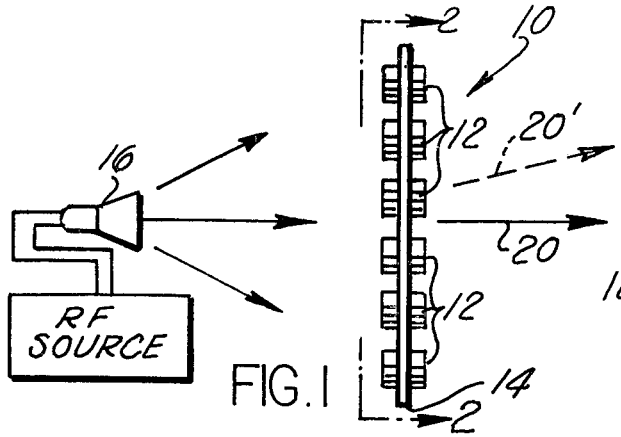
FIG. 1 is an elevational view illustrating a lens array illuminated from one side by a primary radiator and wherein the array is comprised of a plurality of lens cells.
Figure 2:
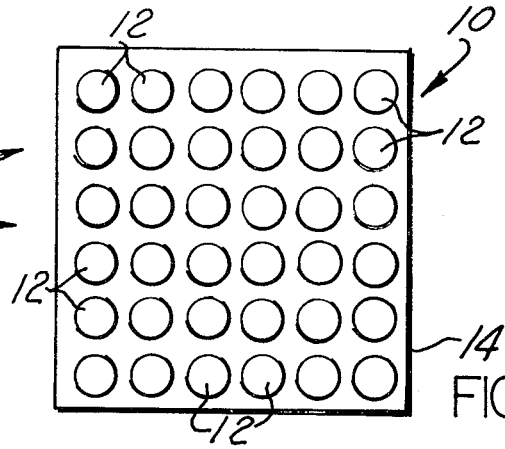
FIG. 2 is a side view taken generally along line 2—2 looking in the direction of the arrows in FIG. 1 and illustrating one side of the lens array with each lens cell being mounted on a ground plane.

Referring now to the drawings wherein the showings are for purposes of illustrating a preferred embodiment of the invention only and not for purposes of limiting the same, there is illustrated in FIG. 1 and 2 a planar lens array 10. This array is comprised of a plurality of lens cells 12 suitably mounted to a conductive member serving as a ground plane 14. This array is preferably illuminated electromagnetically by circular polarized radiation from a feed device, such as, horn 16 excited by a suitable radio frequency source 18 mounted behind the array. In a manner well known in the art, incident radiation received on one side of such a lens array is transmitted through the various lens cells and reradiated from the opposite side in a forward direction, for example as indicated by arrow 20.

Figure 3:
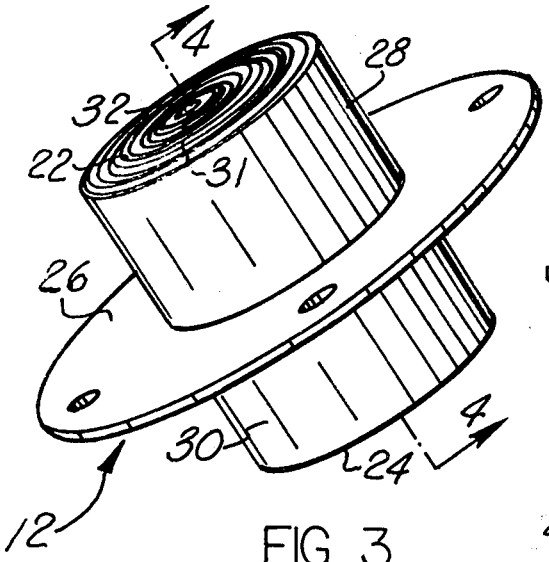
FIG. 3 is a perspective view illustrating the construction of each lens cell.
Figure 4:
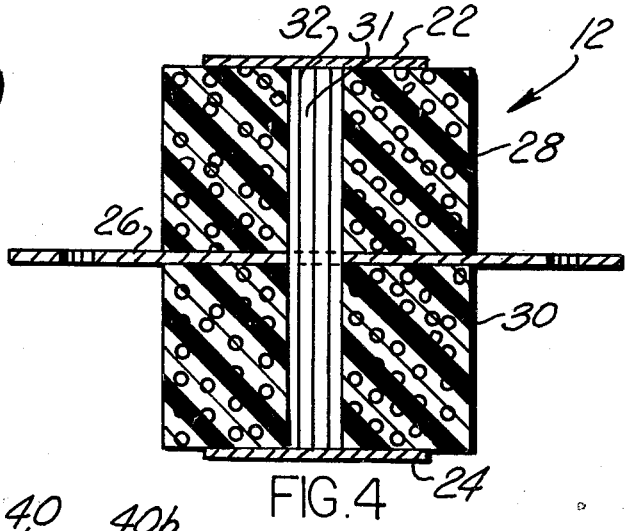
FIG. 4 is a cross-sectional view of a lens cell such as that illustrated in FIG. 3.

Having now generally described one application of the present invention, attention is directed to the antenna lens cell structure employed herein. A preferred embodiment of the lens cell is illustrated in FIGS. 3 and 4 and is comprised of two antenna elements including an element 22 and an element 24 separated from each other and spaced on opposite sides of a conductive member defining a ground plane 26. The antenna elements 22 and 24 each take the form similar to the antenna element illustrated in FIG. 5 to be described in greater detail hereinafter. Such an antenna element is comprised of an even number of arms in excess of two. Preferably it is comprised of a four-arm spiral antenna element wherein the arms of the element are substantially co-planar. As shown in FIG. 3 and 4, antenna elements 22 and 24 lie in parallel planes each spaced by one quarter wave length from ground plane 26. Each antenna element is supported in spaced relationship from the ground plane by means of a spacer 28 or 30. The spacers are affixed to the ground plane 26 and are constructed of electrical insulating material, such as plastic foam. These spacers may be secured to the ground plane in a suitable manner, such as by an epoxy. Similarly, the spiral antenna elements 22 and 24 are each mounted on a plastic substrate, and which is suitably mounted to blocks 28 and 30, as by a suitable epoxy.

As is best shown in FIG. 3, the lens cell is circular in cross section and is provided with a axial bore 32 which extends through spacers 28 and 30 and ground plane 26 to provide access between antenna elements 22 and 24. A four wire transmission line 31 is located in this bore with each wire connecting a respective inner arm end of one antenna element with an associated inner arm end of the other antenna element. The distance between the two antenna elements is on the order of one half wave length and consequently this is the length of the respective transmission lines.

Figure 5:
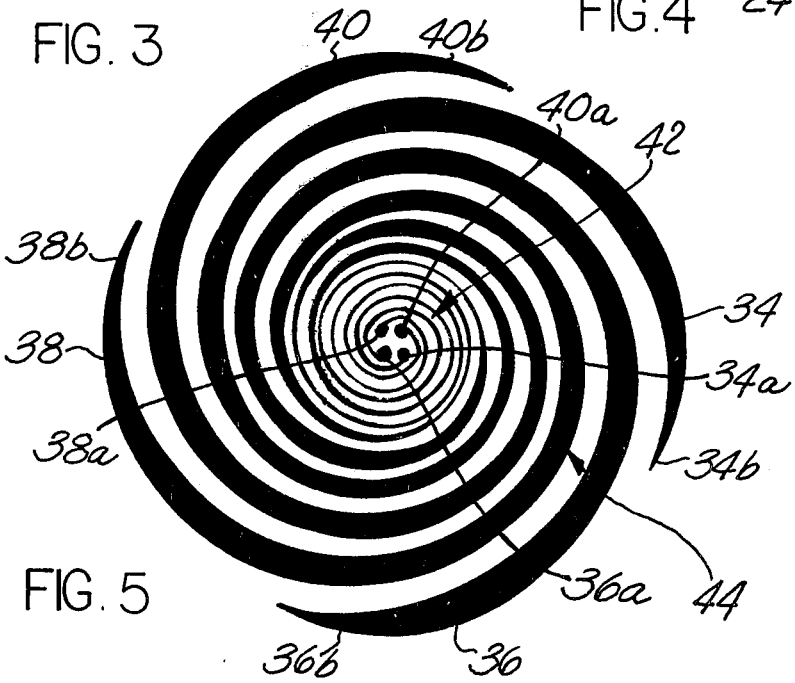
FIG. 5 is an enlarged view showing the construction of each element antenna incorporated in the lens cell.

Reference is now made to FIG. 5 which illustrates the construction of a lens antenna element, such as element 22 or 24. The element shown in FIG. 5 is a spiral antenna element consisting of four spiral arms 34, 36, 38 and 40. The arms may be constructed by printed circuit techniques wherein the four individual arms are conductive copper strips mounted on the surface of a plastic substrate so that the arms are electrically insulated from each other. Each arm is comprised of a combination of an archimedean and logarithmic spiral portions. The inner archimedean portion, generally referred to by the character 42, of each arm extends from the innermost end of the arm and outwardly therefrom in archimedean fashion and terminates into the outer logarithmic portion, generally referred to by the character 44, which continues outwardly until it terminates in an outer arm end. The outer arm ends of arms 34, 36, 38 and 40 are respectively designated by the characters **34*b*, 36*b*, 38*b* and 40*b*** respectively.

As will be brought out hereinafter, antenna elements 22 and 24 are incorporated in the lens such that one of the antenna elements serves a receiving function and the other serves a transmitting function. Assuming that antenna element 22 is mounted so as to receive energy from source 16 then currents are induced in each of the arms at a portion located at a distance from the center which depends on the frequency of the radiowave received. Depending upon the direction of circular polarization of the received wave, the induced currents will travel either initially outwardly or inwardly along the spiral arms.

In the example of FIG. 5, the antenna element is a lefthand element and hence left-hand circular polarization energy will cause currents to be induced therein which will initially travel in a counter-clockwise direction inwardly along the spiral arms, which serve as transmission lines, until they arrive at the inner ends **34*a*, 36*a*, 38*a* and 40*a*. The currents will respectively arrive in a phase progression of 0°, 90°, 180°, and 270° at arm ends 34*a*, 40*a*, 38*a* and 36*a*** due to the spatial configuration of the arms constituting the antenna element.

When the antenna element is performing its transmitting function, antenna excitation currents enter the arms at the inner arm ends **34*a*, 36*a*, 38*a* and 40*a*, and are transmitted in spiral paths outwardly along the arms until they arrive at a place on the antenna which is suitable for radiating waves of the excitation frequency employed. This place or portion of the arm is called the active zone, whose position varies depending upon the frequency of radiation. A portion of the angular ring is indicated in FIG. 5 with reference to a zone 44. This zone is but a portion of a annular ring essentially coaxially about the axis of rotation of the antenna element. This active zone is not sharply defined. Instead the sensitivity of the antenna progressively increases with increasing radius and progressively decreases with further increasing radius and has a maximum sensitivity at some mean radius within zone 44.**

The circumference of the mean circle of the active zone is approximately one wave length of the waves being propogated along the arms. This wave length is slightly smaller than a free space wave length because the velocity of propogation on the arms is slightly smaller than the free space velocity. In the active zone, there is approximately a 360° phase shift standing on any arm of the spiral antenna around a complete loop of the spiral at one instance of time.

If we consider that the currents induced in the active zone commence at the points that the arms intersect a radial line OR, then with the arm lengths being equal the currents will arrive at the respective arm ends by progressive 90° steps. If the left-hand polarized element of FIG. 5 be illuminated with left hand circular polarized energy then the currents induced in the active zone will arrive at the respective inner arm ends 34*a*, 40*a*, 38*a* and 36*a* with a phase progression of 0°, 90°, 180° and 270°. If the element of FIG. 5 is illuminated with cross-polarized energy, thus right-hand circular polarized energy, then the induced currents will initially flow outwardly and arrive at respective outer arm ends 34*b*, 40*b*, 38*b* and 36*b* with a phase progression of 0°, 270°, 180° and 90°.

Phase change or control is effected in accordance with one aspect of this invention by the construction of the elements themselves to obtain a passive phase control. Thus when the various antenna elements are placed in an array as shown in FIG. 2, several of the antenna elements are adjusted to provide different phase responses so as to redirect incident radiation so that it may be reradiated in a controlled direction such, as indicated by arrow 20'. This is achieved by varying the wrap angle and line length of the archimedean portion of each antenna element in accordance with the phase progression that is desired across the array.

Figures 6, 7:
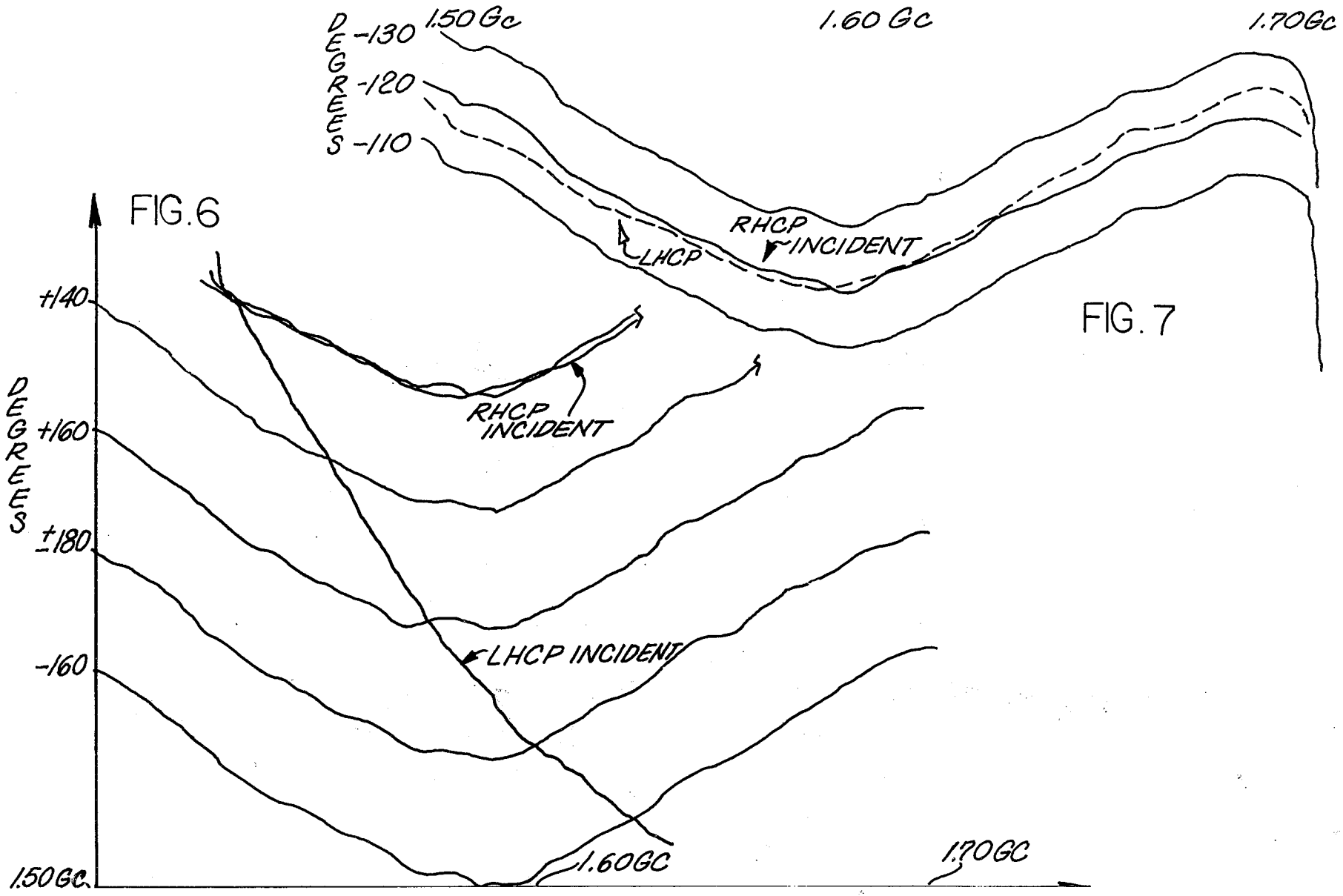
FIG. 6 is a graphical illustration showing the phase response of a cell wherein both spiral antenna elements are the same winding sense.
FIG. 7 is a graphical illustration similar to that of FIG. 6, but showing the phase response of a cell wherein the spiral antenna elements are of opposite sense.

In accordance with the present invention, the lens cell is constructed so that the antenna elements 22 and 24 are oppositely wound spirals. This permits the same lens to be employed to receive and efficiently reradiate electromagnetic energy which may be either left-hand or right-hand circular polarized or of linear polarization and with minimum phase dispersion. If both the antenna elements are of the same hand then the cell will be polarization sensitive, in that it may efficiently reradiate electromagnetic energy of one hand while showing a large phase dispersion in reradiating energy of the opposite hand. This is shown in the graphical illustrations of FIGS. 6 and 7. FIG. 6 illustrates the phase response of a lens cell wherein both antenna elements are of the same winding sense (right hand). It is seen that such a cell is phase sensitive to right-hand circular polarized energy but shows a large phase dispersion with respect to receipt and reradiation of left-hand circular polarized energy. A similar cell was constructed employing elements of opposite sense. In both cases the cells were tested and alternatively illuminated with left-hand and righthand circular polarized energy. The received energy was measured and recorded employing a network analyzer. The graphical illustration shown in FIG. 7 was taken with respect to a cell wherein the antenna elements are of opposite sense and the wave forms show it to be essentially free of phase dispersion.

Figure 8:
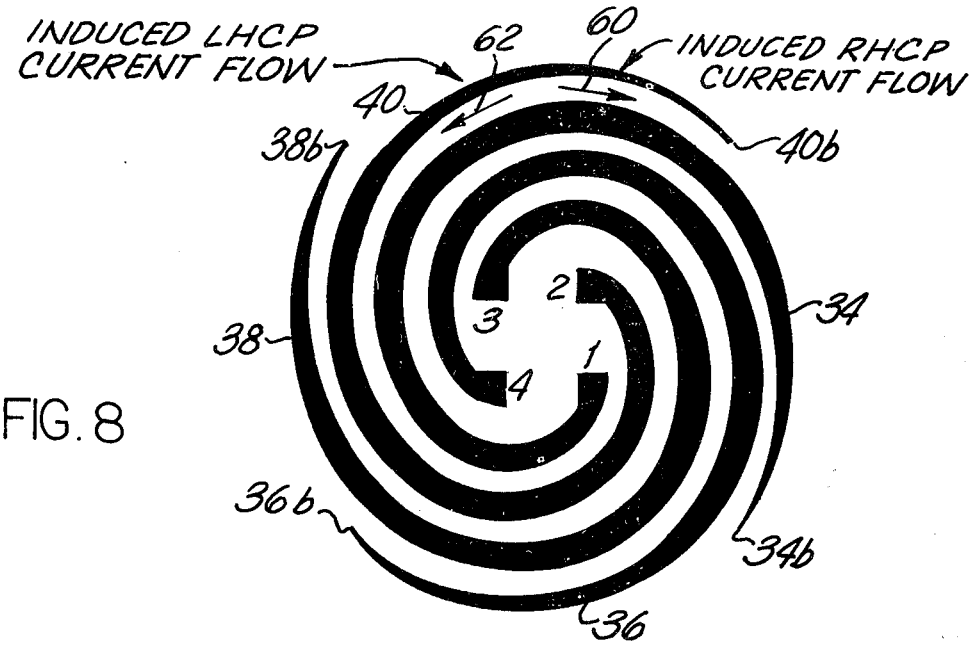
FIG. 8 illustrates a spiral antenna element of the nature employed in the present invention.
Figure 9A:
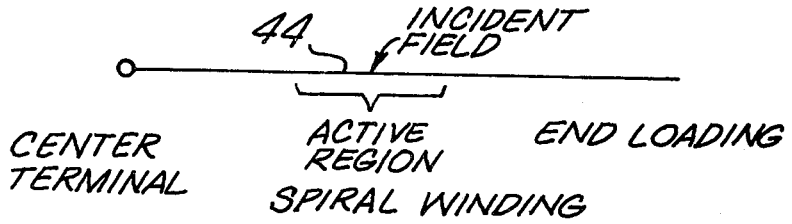
FIGS. 9A, 9B and 9C are schematic illustrations of an antenna element arm and are used in conjunction with describing the operation of the present invention.
Figure 9B:
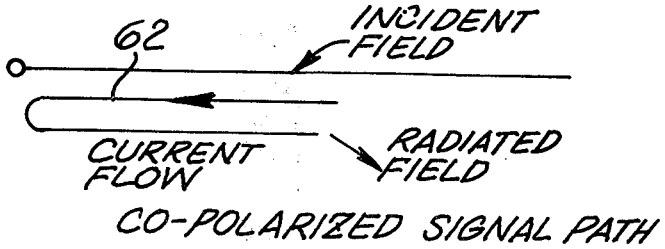
Figure 9C:
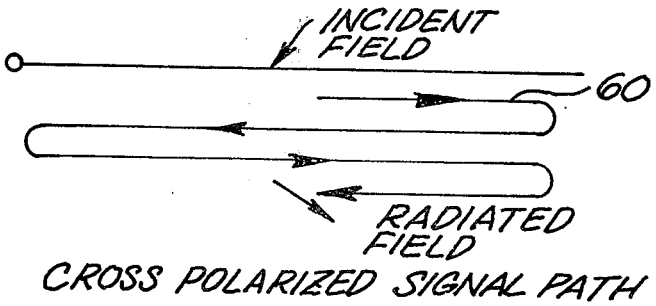

Reference is now made to FIG. 8 which is a schematic illustration of an antenna element but showing only the logarithmic arm portions. This spiral antenna element, as shown in FIG. 8, is a left-hand circular polarized element. Incident electromagnetic energy that is right-hand polarized will induce currents that flow outward as indicated by arrow 60 to the outer ends of the spiral arms. On the other hand, incident energy which is left-hand polarized will cause currents to be induced in the antenna element arms so as to flow inwardly as indicated by the arrow 62, to the inner arm ends. If the antenna element of FIG. 8 be illuminated by right-hand circular polarized energy, then current will initially flow outward toward the outer arm ends. The currents will arrive at the respective outer spiral ends 34*b*, 40*b*, 38*b* and 36*b* with a phase progression of 0°, 270°, 180° and 90° and be reflected back toward the active zone. The insertion phase on arms 34, 40, 38 and 36 is 0°, 270°, 180° and 90°. Consequently, the relative phases of the currents flowing from these arm ends into the active region is 0°, 180°, 0° and 180°.

This out of phase condition will suppress radiation from the active region and the current will continue to flow inwardly toward the spiral center. The relative phase insertion from the active region to the inner arm ends 34*a*, 40*a*, 38*a* and 36*a* is respectively 0°, 90°, 180°and 270°. Consequently then the relative phases of the currents arriving at the inner terminals is 0°, 270°, 180° and 90°. The currents will now flow along the four wire transmission line to the second antenna element and commence flowing outwardly on the associated antenna arms toward the active region. The transmission lines are of one half wave length and, hence, each will provide a phase insertion of an additional 180°. The currents then will arrive at the feed points (inner arm ends) at a respective phase progression of 180°, 90°, 0° and 270° at terminals 34*a*, 40*a*, 38*a* and 36*a* respectively.

Figure 10:
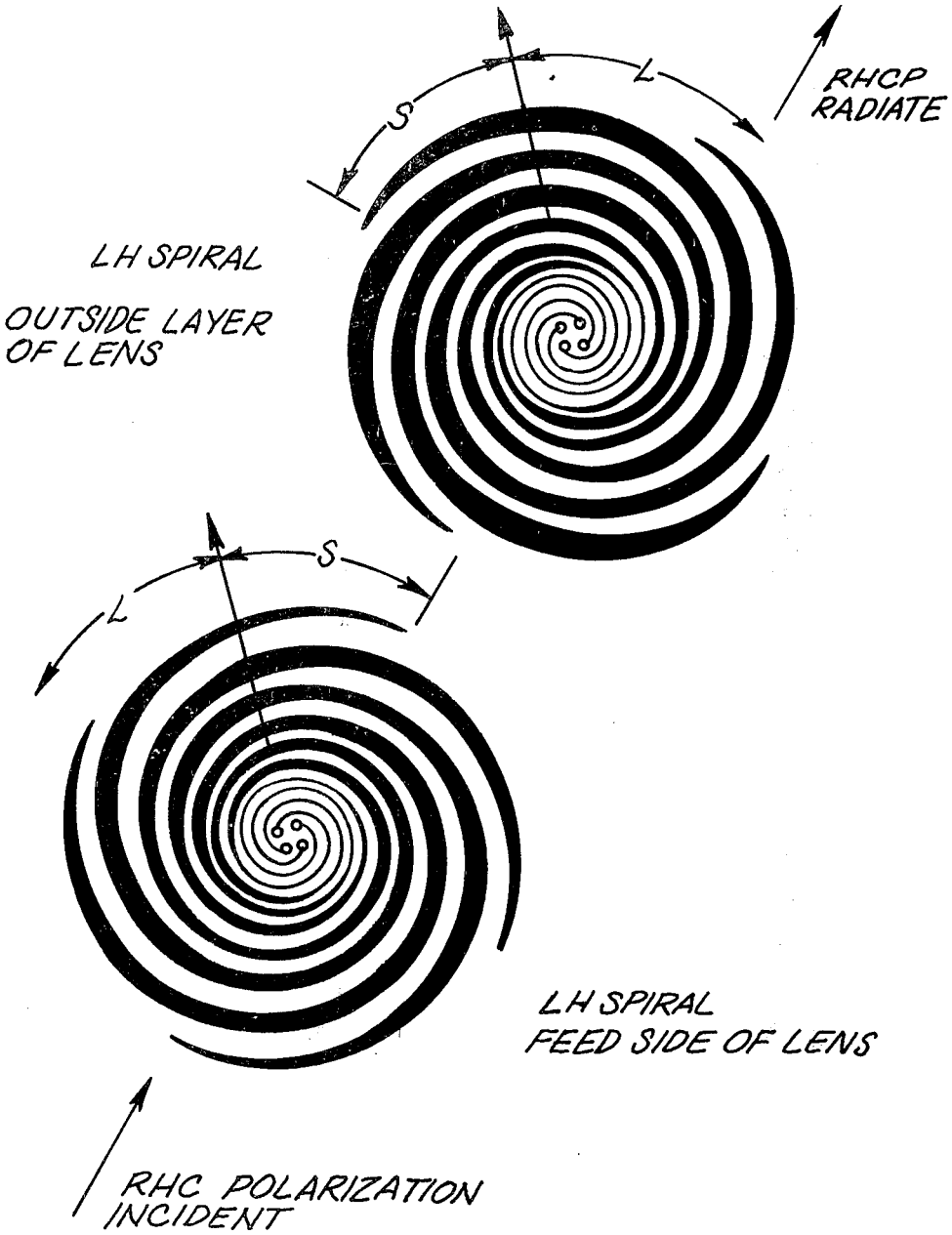
FIG. 10 is a schematic illustration showing the spiral antenna elements of a lens cell wherein both antenna elements are of the same hand; and, FIG. 11 is a schematic illustration showing both spiral antenna elements of a lens cell wherein the antenna elements are of opposite hand.
Figure 11:
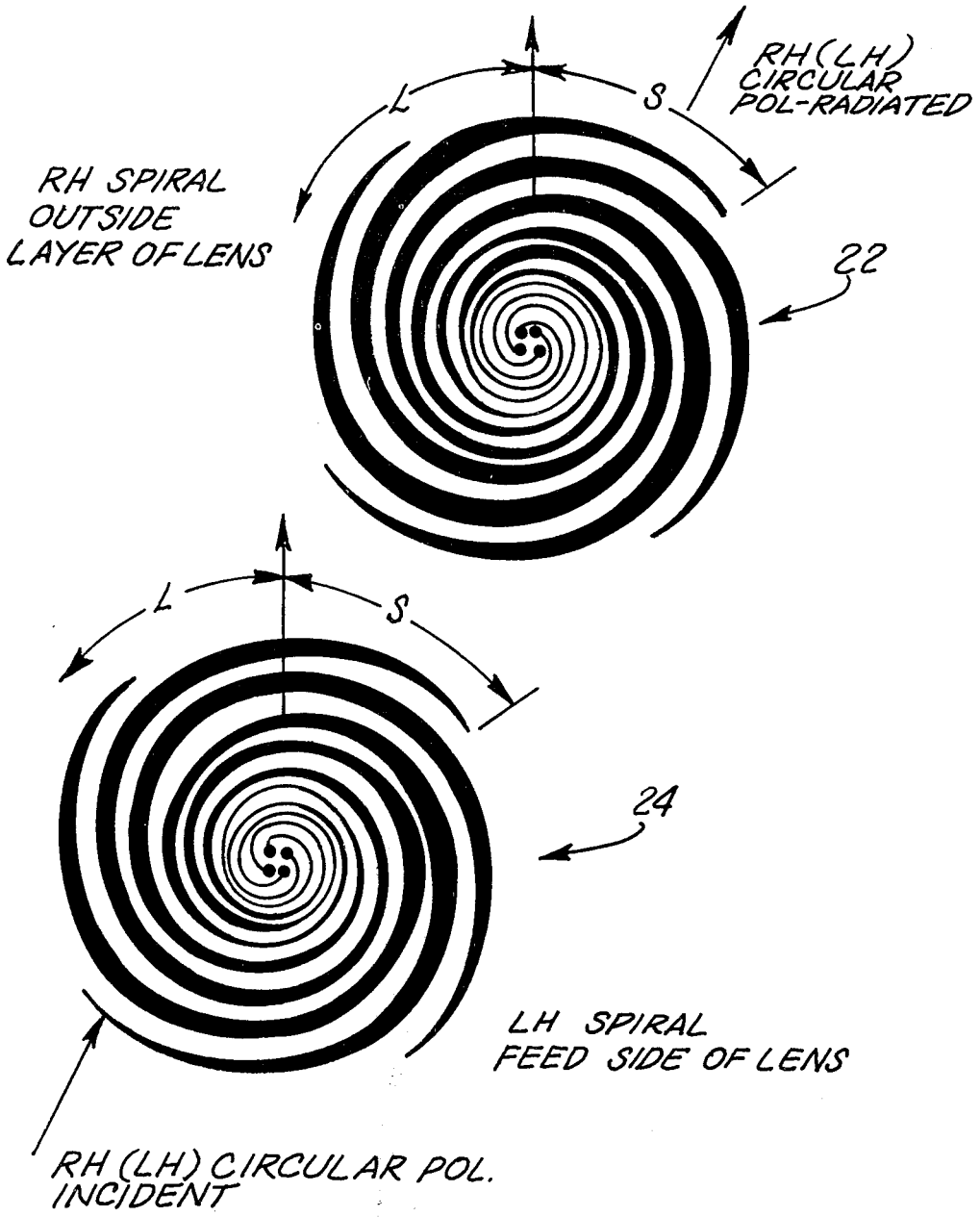

If the construction under consideration employs two antenna elements of the same hand, such as in FIG. 10, then we will have a different result in the total current path to achieve efficient reradiation than if we have antenna elements of opposite sense, as shown in FIG. 11. Assume for a moment that the antenna elements of the lens are of the same hand, such as that shown in FIG. 10, then as the signals arrive at the feed points of the second antenna element they will exhibit a phase progression of 180°, 90°, 0° and 270°, at the inner arm ends 34*a*, 40*a*, 38*a* and 36a respectively. The phase insertion from these feed points to the active region will respectively be 0°, 270°, 180° and 90°. Consequently then, as the currents flow outwardly along the spiral arms they will reach the active zone and will be 180° out of phase, with a phase progression of 180°, 0°, 180° and 0° in arms 34, 40, 38 and 36 respectively. Consequently then, the currents will continue to flow outward to the outer ends of the spiral arms. The currents will be reflected from the outer ends with a phase insertion taking place so that the currents arrive back at the active region flowing inward and in phase. This in-phase condition will cause energy to be efficiently radiated from the active region.

Continuing in this example with respect to the lens cell of FIG. 10, attention will now be directed to the operation that ensues when the incident polarization is left hand rather than right hand. Currents induced in the receiving antenna element will flow inwardly. These currents will arrive at the inner arm ends with a phase progression of 0°, 90°, 180° and 270° at inner arm ends 34a, 40a, 38a and 36a respectively. The currents will then be transmitted along the four wire transmission line to the inner arm ends of the transmitting antenna element. In the example being given with reference to FIG. 10, the transmitting antenna element is also a left-hand circular polarized antenna element. The currents that arrive from the forward line transmission line will arrive with a phase progression of 180°, 270°, 0°, and 90°. Again, the phase insertion will be 0°, 270°, 180° and 90° on arms 34, 40, 38 and 36 respectively of the transmitting antenna element. Consequently then, the currents will travel outwardly and arrive in phase at the active zone and obtain efficient radiation.

At this point it is apparent that whereas efficient radiation is obtained with either left-hand or right-hand incident polarization, there is a disparity in the distance that current must flow. Both must travel a distance *d*, the length of the transmission line. But, the current resulting from received right-hand circular polarization must travel an additional distance of 4*s*, where *s* is the distance from the active zone to the outer arm end. This is summarized below in Table 1.

TABLE I

| | Incident Polarization LHCP | RHCP |
|---|---|---|
| Distance from active region into first spiral center | L | L + 2s |
| Distance through lens | d | d |
| Distance from second spiral center to active region (in-phase) | L | L + 2s |
| Total Path Length | 2L + d | 2L + d + 4s |

This extra distance, 4s, that the current must travel results in the phase dispersion between co-polarized and crosspolarized energy. This phase dispersion is evident from a comparison of the graphical illustrations in FIGS. 6 and 7, discussed hereinbefore.

In accordance with an important aspect of the present invention, this phase dispersion is substantially eliminated, as is indicated by the graphical wave form of FIG. 7, by employing a lens cell construction wherein both the receiving antenna element and the transmitting antenna element are of opposite hand. An embodiment is illustrated in FIG. 11 wherein the receiving antenna element (shown in the lower portion of the drawing) is a left-hand circular polarized spiral antenna element, as viewed from the feed side of the lens. The other antenna element, (shown in the upper portion of the Figure) is a right-hand circular polarized spiral antenna element, as viewed from the outside layer of the lens. As will be appreciated from the description which follows below, the path length for current resulting from either co-polarization or cross-polarization incident wave fronts is the same, thereby minimizing phase dispersion.

The above antenna elements comprising the lens of FIG. 11 take the form as described hereinbefore with reference to FIG. 5 and, consequently, to simplify the description which follows the same character references will be employed. The following discussion, will first examine the operation resulting when the incident polarization is left-hand circular polarized and then the operation when the incident polarization is right-hand circular polarized.

When the left-hand circular polarized antenna element receives an incident wave front that is left-hand circular polarized energy the currents induced in the active zone will be directed inwardly toward the inner arm ends of the antenna element. The currents will travel and arrive at arm ends 34*a*, 40*a*, 38*a* and 36*a* with a phase progression respectively of the 0°, 90°, 180° and 270°. The currents will then flow along the transmission line providing a 180° phase change so that the currents arrive at the feed point terminal ends 34*a*, 40*a*, 38*a* and 36*a* of the transmitting antenna element with a respective phase progression of 180°, 270°, 0° and 90°. The phase insertion from the feed points to the active zone is respectively 0°, 90°, 180° and 270° so that the currents arrive at the active zone 180° out of phase. The currents will continue to flow to the outer arm ends of the transmitting antenna element and be reflected back toward the inner arm ends with the currents flowing in phase as they reach the active zone. The in phase currents will cause efficient radiation of left-hand circular polarized energy.

Assume now that the receiving antenna element shown in the lower portion of FIG. 11 is illuminated with right-hand circular polarized energy. In such case, the currents induced in the active zone will initially flow outward and be reflected at the outer arm ends and arrive back in the active zone in an out of phase condition. The currents then will continue to flow to the inner arm ends and arrive at arm ends 34*a*, 40*a*, 38*a* and 36*a* with a respective phase progression of 0°, 270°, 180° and 90°. The current will then be transmitted along the four wire transmission line and arrive at the feed point terminals of the transmitting right-hand circular polarized antenna element with a phase progression of 180°, 90°, 0° and 270° at arm ends 34*a*, 40*a*, 38*a* and 36*a* respectively. The insertion phase to the active zone is 0°, 90°, 180° and 270°. Consequently then, as the currents flow outwardly they will arrive at the active zone in-phase, resulting in efficient radiation of right-hand circular polarized energy.

From the above discussion with reference to the embodiment of the invention shown in FIG. 11 it will be noted that the total path length for current flow resulting from either copolarized or cross-polarized energy is the same. This is summarized below in Table II.

TABLE II

| | Incident Polarization RHCP | LHCP |
|---|---|---|
| Distance from active region to center of LH spiral | L + 2s | L |
| Distance through lens | d | d |
| Distance from RH spiral center to active region (in-phase) | L | L + 2s |
| Total Path Length | 2L + d + 2s | 2L + d + 2s |

As was discussed hereinbefore, phase control is incorporated into the antenna elements themselves. That is when a plurality of antenna elements are placed in an array as is shown in FIG. 2, the various antenna elements are adjusted to provide different phase responses in order to redirect incident radiation so that is may be radiated in a particular direction such as that indicated by arrow 20' as opposed to a different direction such as that indicated by arrow 20 (see FIG. 1). Preferably, the differential phase shift between the various antenna elements within the lens is accomplished by varying the wrap angles of the inner portions of the spiral elements with respect to each other. This changes the relative line lengths through which the currents in the arms travel and, hence, changes the insertion phase discussed herein. The tighter the wrap angle for the same size antenna element the longer will be the various arms making up the antenna element for a given antenna element diameter. Consequently, a tighter wrap angle will result in arms of greater length and, hence, greater insertion phase. By providing antenna elements with different wrap angles and, hence, different arm lengths the insertion phases from element to element may be controlled in accordance with a desired phase progression across the array. Preferably each lens cell is constructed such that one half of the desired phase shift is incorporated into each spiral antenna element. This is accomplished by appropriately adjusting the wrap angle and arm length. However, the desired phase shift may also be obtained by dielectrically loading the four wire transmission line between the spiral elements of a lens cell or by twisting the transmission lines in a helical fashion. However, varying the wrap angle and length of the spiral arms has the advantage in that it lends itself to photoetching techniques.

From the foregoing it is seen that by constructing a lens cell with two antenna elements of opposite hand, as shown in FIG. 11, a phase insensitive lens cell is obtained. The receiving element may be illuminated with either right-hand or left-hand or linear polarization electromagnetic energy. When the receiving antenna element is illuminated with left-hand circular polarized energy the transmitting antenna element will transmit left-hand circular polarized energy. Conversely, when the receiving antenna element is illuminated with right-hand circular polarized energy the transmitting antenna element will transmit righthand circular polarized energy. As brought out in Table II and the discussion with reference to FIG. 11, the path length for current flow is the same and, hence, the phase dispersion is essentially eliminated as is seen from the graphical illustration of FIG. 7.

Although the invention has been described in conjunction with a preferred embodiment it is to be appreciated that various modifications and arrangements of parts may be made within the spirit and scope of the invention as defined by the appended claims.

What is claimed is:

1. An antenna lens for receiving and reradiating electromagnetic energy comprising:

first and second spaced apart antenna elements for respectively receiving and reradiating electromagnetic energy;

each said element comprising an even pair of electrically conductive spiral arms spaced from each other, said arms having a common axis of rotation, each said arm having inner and outer arm ends, said inner arm ends being rotationally displaced about said axis relative to each other by a given angle to achieve a given rotational phase progression about said common axis;

said first and second antenna elements being of opposite geometric winding sense; and transmission means including a plurality of conductors each interconnecting a said arm of said first element with an associated arm of said second element.

2. An antenna lens as set forth in claim 1 wherein said transmission means is on the order of one-half wave length.

3. An antenna lens as set forth in claim 1 including means defining a ground plane interposed between said first and second antenna elements

4. An antenna lens as set forth in claim 3, wherein said ground plane is located approximately one-quarter wave length from each said element.

5. An antenna lens as set forth in claim 1, wherein said plurality of arms of each said antenna element define a coplanar structure.

6. An antenna lens as set forth in claim 1, wherein each said conductor interconnects an inner arm end of said first element with an inner arm end of an associated arm of said second element.

7. An antenna lens as set forth in claim 1 wherein each said antenna element is comprised of said conductive arms which are configured so as to have an archimedean portion and a logarithmic portion.

8. An antenna lens as set forth in claim 7 wherein archimedean portion of each said arm extends from said inner end outwardly and terminates into said logarithmic portion.

9. An antenna lens as set forth in claim 8, wherein the wrap angle and length of the archimedean portion of said lens is chosen so as to provide a given phase relationship of the reradiated energy relative to that by other similarly constructed ones of said lenses in an array of lenses.

10. An antenna lens as set forth in claim 1, wherein said even number of pairs of said conductive arms includes four conductive arms, said arms being of like configuration and length.

11. An antenna lens as set forth in claim 10, wherein said inner arm ends are rotationally displaced about said axis relative to each other by 90° so as to achieve a rotational phase progression of 0°, 90°, 180° and 270°.

12. An antenna lens as set foth in claim 11, wherein said arms of both said elements of a said lens have a given wrap length and wrap angle extending outwardly from said inner arm ends and chosen so that when said lens is in an array of lenses a desired phase relationship of reradiated energy to received energy is achieved.

* * * * *